US005251707A

United States Patent [19]

Grahl

[11] Patent Number: 5,251,707

[45] Date of Patent: Oct. 12, 1993

[54] ICE AUGER CUTTING HEAD

[76] Inventor: Paul F. Grahl, P.O. Box 909, Campbellsport, Wis. 53010

[21] Appl. No.: 858,008

[22] Filed: Mar. 26, 1992

[51] Int. Cl.[5] ..... E21B 10/44

[52] U.S. Cl. ..... 175/18; 299/24

[58] Field of Search ..... 175/18, 394; 299/24

[56] References Cited

U.S. PATENT DOCUMENTS

| | | | |
|---|---|---|---|
| D. 240,263 | 6/1978 | Southall . | |
| D. 248,659 | 7/1978 | Schneider, Sr. . | |
| 2,709,572 | 5/1955 | Ageborn . | |
| 2,709,573 | 5/1955 | Reed | 175/394 X |
| 3,051,253 | 8/1962 | McCann . | |
| 3,175,630 | 3/1965 | Hein et al. | 175/18 X |
| 3,760,890 | 9/1973 | Rantanen . | |
| 3,995,706 | 12/1976 | White | 175/394 X |
| 5,038,870 | 8/1991 | Kuronen . | |

*Primary Examiner*—William P. Neuder

*Attorney, Agent, or Firm*—Jacobson, Price, Holman & Stern

[57] ABSTRACT

A one piece, panel-like and generally diametric blade is mounted upon one end of a shaft portion for rotation therewith. The blade is generally S-shaped in configuration as viewed along the center axis of the shaft portion and includes a pair of inner and outer cutting blade edges extending along each of the wing portions of the blade disposed on opposite sides of the shaft portion. The inner ends of the inner cutting blade edges terminate a spaced distance outwardly of the center axis of the shaft portion, the inner and outer cutting blade edges are each outwardly inclined away from the axial direction of the shaft portion in which the blade edges face. The inner cutting blade edges are spaced forward of the outer blade cutting edges in the direction in which the cutting edges face, the outer ends of the inner cutting blades are spaced further outward from the center axis of the shaft portion than the inner ends of the outer blade cutting edges an the outer ends of the inner cutting blade edges trail in the direction of intended rotation of the cutting head while the outer ends of the outer blade edges lead in the direction of intended rotation of the cutting head.

12 Claims, 1 Drawing Sheet

ICE AUGER CUTTING HEAD

BACKGROUND OF THE INVENTION

1. FIELD OF THE INVENTION

The instant invention relates to an ice auger cutting head embodying a one piece construction having diametrically opposite, generally radially outwardly projecting cutting edges configured to perform a smooth and rapid cutting action upon a body of ice against which the cutting head is advanced such that a hole may be cut in the body of ice in a relatively short time through the utilization of a minimum amount of rotary input torque.

2. DESCRIPTION OF RELATED ART

Various different types of drill bits including some of the general structural and operational features of the instant invention are disclosed in U.S. Pat. Nos.: 2,709,572, 3,051,253, 3,760,890, 5,038,870 and U.S. Pat. Nos. Des. 240,263 and 248,659. However, these previously known forms of drilling bits do not include the overall combination of structural operational features of the instant invention which coact to provide a bit capable of quickly and smoothly cutting through a body of ice with a minimum amount of rotary input torque.

SUMMARY OF THE INVENTION

The ice auger cutting head of the instant invention includes two pairs of diametrically opposite, generally outwardly projecting inner and outer cutting blades with the inner blades including beveled cutting edges which are disposed at a greater approach angle than the beveled cutting edges of the outer blades. Furthermore, the inner ends of the inner cutting edges terminate a distance spaced outward of the longitudinal center axis of the cutting head to define a chip throat therebetween and the outer ends of the inner cutting blades terminate radially outward of the inner ends of the outer cutting blades. Still further, the outer ends of the inner blades trail the inner ends thereof in the direction of intended rotation of the cutting head while the inner ends of the outer blades trial the outer ends thereof in the direction of intended rotation of the cutting head. Finally, the inner cutting blades are disposed entirely forward of the outer cutting blades in the direction in which the head is advanced relative to a workpiece along the center axis of the head and both the inner and outer blade edges are outwardly and rearwardly inclined relative to a plane normal to the center axis of the cutting head with the rearward inclination of the inner cutting edges being greater than the rearward inclination of the outer cutting edges.

The main object of this invention is to provide an ice auger cutting head which will function to smoothly and quickly cut through a body of ice with a minimum amount of rotary input torque.

Another object of this invention is to provide an ice auger cutting head in accordance with the preceding object and whose structural components enable the head to be of one piece construction and basically formed through a single stamping process.

Still another object of this invention is to provide an ice auger cutting head including longitudinally straight beveled cutting edges to thereby allow the cutting edges to be resurfaced more quickly and efficiently when the need arises for the cutting edges to be sharpened.

Yet another object of this invention is to provide an ice auger cutting head constructed in a manner such that the amount of external axial force on the cutting head required to effect an efficient and quick cutting action on a body of ice will be maintained at a minimum.

A final object of this invention to be specifically enumerated herein is to provide an ice auger cutting head in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
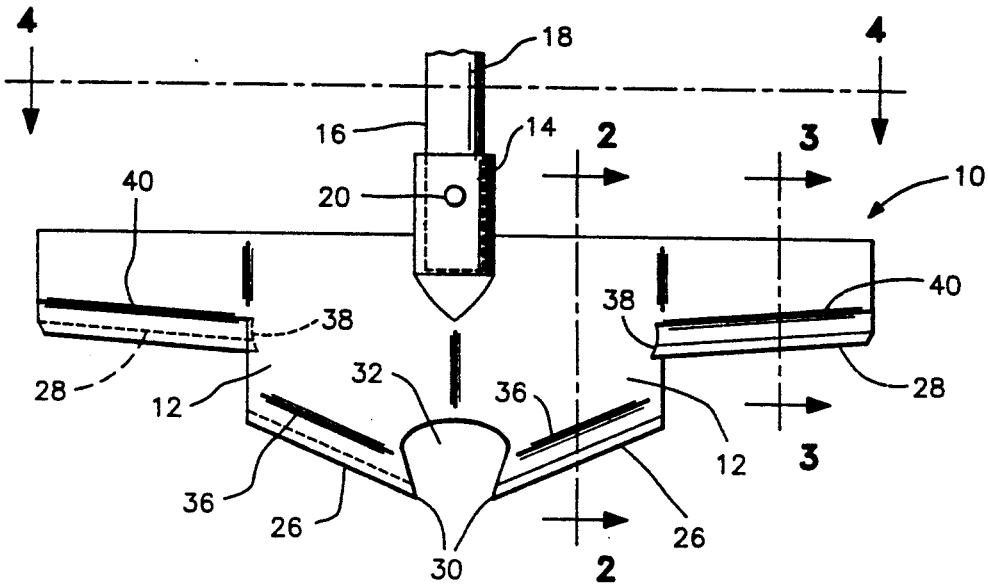
FIG. 1 is a side elevational view of an auger cutting head constructed in accordance with the present invention.

Referring now more specifically to the drawings the numeral 10 generally designates an ice auger cutting head constructed in accordance with the present invention. The head 10 is constructed of a single panel 12 of rigid metal and includes a central tubular shank portion fixedly mounted thereon into which the lower end 16 of a drive shank portion 18 is secured in any convenient manner such as by a diametric pin 20.

Figure 4:
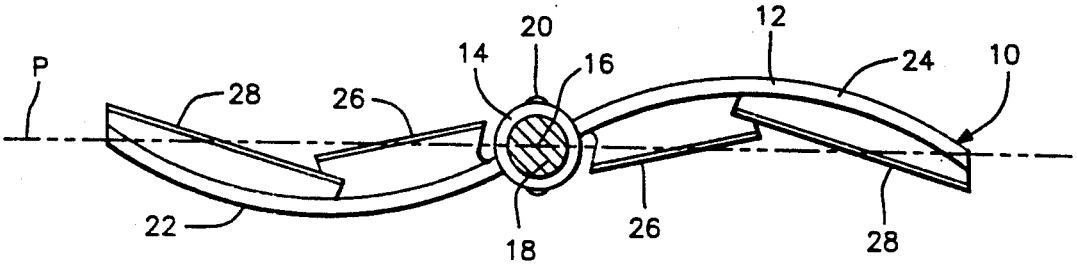
FIG. 4 is a horizontal sectional view taken substantially upon the plane indicated by the section line 4—4 of FIG. 1.

The shank portions 14 and 18 define an elongated shaft portion adapted to be rotated about its longitudinal axis. The shank portions 14 and 18 define a first axial end of the head 10 and the second axial end of the head 10 is defined by the single, generally diametric panel 12 from which the shank portion 14 is permanently mounted. Opposite ends of the panel 12 define opposite side laterally outwardly projecting wings 22 and 24 and each wing includes elongated, beveled inner and outer blade edges 26 and 28 extending longitudinally therealong and facing axially of the head 10 outward of the end thereof opposite the shank portion 18. The edges 26 and 28 face in the same direction of rotation of the head about the center axis of the shank portion 18 (clockwise as viewed in FIG. 4).

Further, the edges 26 and 28 are longitudinally straight and are inclined outwardly toward the end of the head 10 in which the shank portion 18 projects, the blade edges 26 being inclined more greatly than the edges 28. In addition, the inner ends 30 of the edges 26 are spaced slightly outward of the center axis of the shank portion 18 to thereby define a chip throat 32 therebetween and the blade edges 26 are inclined rearwardly toward their outer ends relative to a diametric plane P of the shank portion 18 passing through the longitudinal mid-portions of the blade edges 26 and 28. Further, the blade edges 28 are inclined forwardly toward their outer ends relative to the plane P and, as also may be seen from FIG. 4, the outer ends of the blade edges 26 are spaced a greater radial distance from the longitudinal center line of the shank portion 18 than the inner ends of the blade edges 28.

Figure 2:
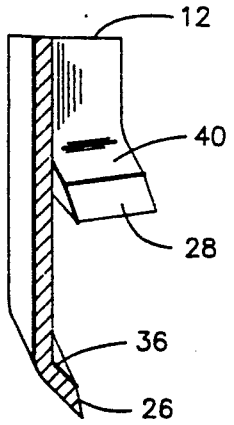
FIG. 2 is an enlarged vertical sectional view taken substantially upon the plane indicated by the section line 2—2 of FIG. 1.
Figure 3:
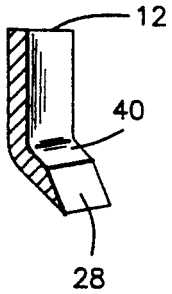
FIG. 3 is an enlarged vertical sectional view taken substantially, upon the plane indicated by the section line 3—3 of FIG. 1.

From FIG. 1 of the drawings it may be seen that the blade edges 26 are inclined approximately 30 degrees relative to a plane normal to the longitudinal center line of the shank portion 18 and that blade edges 28 are inclined only 10 degrees or less relative to a plane normal to the longitudinal center line of the shank portion 18. However, the beveled edges 26 enjoy a higher angle of attack relative to a plane normal to the longitudinal center line of the shank portion 18 than the beveled edges 28, see FIG. 2.

It is also pointed out that the outer beveled edges 28 extend throughout a greater radial extent of the longitudinal center line of the shank portion 18 than the inner beveled edges 26. Also, from FIG. 4 of the drawings, it may be seen that the panel 12 is S-shaped as viewed along the center axis of the shank portion 18 and this construction, together with the manner in which the panel 12 may be formed in a single stamping operation, ensures a smooth cutting operation of the head 10 on a body of ice.

Before the stamping operation, the panel 12 is generally of a plan shape such as that seen in FIG. 1, except that the throat 32 includes generally parallel opposite sides edges, which side edges are illustrated as downwardly convergent in FIG. 1 in view of the curvature of those portions 36 of the panel 12 from which the edges 26 are supported. In addition, the panel 12 is slit as at 38 and, therefore, the curvature of the panel as at 40 on the portions thereof defining the edges 28 (and because of the S-shaped configuration of the panel 12), places the inner extremity of the cutting edges 28 radially inwardly of the outermost extremities of the edges 26.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An ice auger cutting head including an elongated, center axis defining shaft portion having first and second ends facing in opposite first and second directions, said first end being adapted to have rotary input torque applied thereto for rotating said shaft portion about said center axis, said second end including opposite side laterally outwardly projecting panel-like wings, each of said wings including elongated, beveled inner and outer blade edges extending therealong and facing in said second direction with all of said edges facing in the same direction of rotation of said head about said center axis, said blade edges being generally longitudinally straight and including inner and outer ends, said blade edges being inclined outwardly in said first direction, said blade edges being inclined relative to a plane normal to said center axis with the beveled edges of said inner blade edges being inclined relative to said plane more than the outer beveled blade edges, said inner beveled blade edges including inner terminal ends adjacent, but spaced outwardly of said center axis, said inner blade edges being disposed fully forward of said outer blade edges in said second direction.

2. The cutting head of claim 1 wherein the outer ends of said inner edges trail the inner ends thereof relative to radial planes of said center axis passing through the longitudinal central portions of said inner edges.

3. The cutting head of claim 1 wherein the inner ends of said outer edges trail the outer ends thereof relative to radial planes of said center axis passing through the longitudinal central portions of said outer edges.

4. The cutter head of claim 1 wherein said wings all are integrally formed of a single piece of material.

5. The cutter head of claim 1 wherein the radial extent of said outer blade edges relative to said center axis is greater than the radial extent of said inner blade edges.

6. An ice auger cutting head including an elongated, center axis defining shaft portion having first and second ends facing in opposite first and second directions, said first end being adapted to have rotary input torque applied thereto for rotating said shaft portion about said center axis, said second end including opposite side laterally outwardly projecting panel-like wings, which of said wings including elongated, beveled inner and outer blade edges extending therealong and facing in said second direction with all of said edges facing in the same direction of rotation of said head about said center axis, said blade edges being generally longitudinally straight and including inner and outer ends, said blade edges bering inclined outwardly in said first direction, said blade edges being inclined relative to a plane normal to said center axis with the beveled edges of said inner blade edges bering inclined relative to said plane more than the outer beveled blade edges, said inner beveled blade edges including inner terminal ends spaced outwardly of said center axis, said inner blade edges being disposed fully forward of said outer blade edges in said second direction, the inner ends of said outer edges trailing the outer ends thereof relative to radial planes of said center axis passing through the longitudinal central portions of said outer edges, the outer ends of said inner edges trailing the inner ends thereof relative to radial planes of said center axis passing through the longitudinal central portions of said inner edges.

7. The cutter head of claim 4 wherein the longitudinal central portions of said edges lie substantially upon the same diametric plane of said center axis.

8. The cutter head of claim 6 wherein the outer end of each inner edge extends radially outwardly of said center axis a radial distance greater than the radial spacing of the inner end of the corresponding outer edge relative to said center axis.

9. An ice auger cutting head including an elongated, center axis defining shaft portion having first and second ends facing in opposite first and second directions, said first end being adapted to have rotary input torque applied thereto for rotating said shaft portion about said center axis, said second end including opposite side laterally outwardly projecting panel-like wings, which of said wings including elongated, beveled inner and outer blade edges extending therealong and facing in said second direction with all of said edges facing in the same direction of rotation of said head about said center axis, said blade edges being generally longitudinally straight and including inner and outer ends, said blade edges bering inclined outwardly in said first direction, said blade edges being inclined relative to a plane normal to said center axis with the beveled edges of said inner blade edges bering inclined relative to said plane more than the outer beveled blade edges, said inner beveled blade edges including inner terminal ends spaced outwardly of said center axis, said inner blade edges being disposed fully forward of said outer blade edges in said second direction, the outer end of each inner edge extending radially outwardly of said center axis a radial distance greater than the radial spacing of the inner end of the corresponding outer edge relative to said center axis.

10. The cutter head of claim 9 wherein the outer ends of said inner edges trail the inner ends thereof relative to radial planes of said center axis passing through the longitudinal central portions of said inner edges.

11. The cutter head of claim 10 wherein the inner ends of said outer edges trail the outer ends thereof relative to radial planes of said center axis passing through the longitudinal central portions of said outer edges.

12. The cutter head of claim 11 wherein the longitudinal central portions of said edges lie substantially upon the same diametric plane of said center axis.

* * * * *